United States Patent [19]

Couvrette

[11] Patent Number: 4,603,643

[45] Date of Patent: Aug. 5, 1986

[54] EXPANDABLE STRUCTURE FOR AUTOMATIC TELLER MACHINES

[76] Inventor: Edward F. Couvrette, 527 10th Ave., San Diego, Calif. 92101

[21] Appl. No.: 624,189

[22] Filed: Jun. 25, 1984

[51] Int. Cl.[4] ..... G07G 5/00

[52] U.S. Cl. ..... 109/24.1; 109/2; 52/67

[58] Field of Search ..... 109/2, 24, 24.1, 49.5, 109/50, 58, 45, 47, 48, 49, 64, 66, 73, 81; 52/67, 69

[56] References Cited

U.S. PATENT DOCUMENTS

| | | | |
|---|---|---|---|
| Re. 22,431 | 2/1944 | Sloan, Jr. | 52/67 |
| 3,897,901 | 8/1975 | Grosswiller, Jr. | 109/24.1 |
| 4,192,544 | 3/1980 | Patterson | 52/67 |
| 4,399,755 | 8/1983 | Wiedmann et al. | 109/2 |
| 4,497,261 | 2/1985 | Ferris et al. | 109/2 |
| 4,513,670 | 4/1985 | Berman | 109/24.1 |

*Primary Examiner*—Thomas J. Holko
*Assistant Examiner*—Neill Wilson
*Attorney, Agent, or Firm*—Frank D. Gilliam

[57] ABSTRACT

An expandable security structure for housing an automatic teller machine. The structure comprises a pair of telescopic sections that nest together to provide a minimum dimensioned width structure for housing the automatic teller machine and telescoped to a maximum dimension to provide a structure sufficiently large to enable the automatic teller machine to be serviced by personnel from within the structure. The entry door into the structure permits passage to the interior thereof only when the structure is in at least a partially telescoped from its nested position. Either a motor or manual crank is provided for relative movement of the sections. In a second embodiment the automatic teller machine is translatable relative to the translatable section from a first position where its front surface is substantially flush with the exterior wall of the structure to a second extended position where the front surface is positioned exteriorly remote therefrom. Locking mechanisms are provided to prevent unauthorized telescoping of the sections and translation of the automatic teller machine of the second embodiment.

10 Claims, 11 Drawing Figures

EXPANDABLE STRUCTURE FOR AUTOMATIC TELLER MACHINES

BACKGROUND OF THE INVENTION

As a convenience for customers, banks and other institutions involved in receiving and dispensing of money have been increasingly installing automatic unmanned teller machines. Originally, these machines were only installed within the principal premises of the institutions. More recently, however, these machines are being installed at locations remote from the principal banking premises, such as, driveways adjacent thereto, shopping centers, parking lots, building lobbies, airports, etc., both for walk up and drive-up application. These remotely located automated teller machines permit a customer to identify himself to the computer controlling the machine and then transact normal banking transactions such as, deposits, withdrawals, payments, etc., just as if the customer were physically present at the institution. An essential factor in the selection of suitable locations for these automatic teller machines is the security of the machine and its availability to the customer. The need for security is obvious when it is appreciated that these machines will frequently contain large sums of cash. A less obvious factor is the installation of such a machine at a location where a minimum of space is available or where space is relatively expensive. Such a location is the use of driveways adjacent to one or more of these machines which are mounted on minimum width islands between or adjacent to these driveways.

U.S. Pat. No. 1,735,966 by inventor R. S. Garver teaches an adjustable steel vault having telescope sections which can be positioned to expand from a nested position to a telescoped position. A door is provided on an end of one section which allows access to the interior of the structure regardless of the relative positions of the sections. A manually operated crank and panel assembly is provided to decrease the size of the structure from a manually telescoped position toward a nested position. The sections are supported on the supporting surface by rollers.

U.S. Pat. No. 4,399,755 by inventor Paul R. Wiedmann teaches a structure particularly adapted for use with an automatic teller machine for location at a site remote from a financial institution. This structure is adapted to be installed on a small space as adjacent to or between driveways when in use and mounted on a base are components which rotate from a use position to a service position while maintaining environmental integrity to the interior of the structure. Like the prior mentioned structure, a door on one end thereof provides access to the interior of the structure when the interior components are in either a use or service position. The construction of this structure is labor intensive, economically expensive to construct, will not be readily adaptable to the various automatic teller machines and is incompatible with combined computers and automatic teller machines.

There has not been a completely secure and versatile structure for housing automatic teller machines or the like until the emergence of this invention.

SUMMARY OF THE INVENTION

The invention is directed to a secure expandable structure for the housing of an automatic teller machine or the like which when in an automatic teller operable mode takes up a minimum amount of surface space and when in a service mode expands only over a driveway or walkway positioned for that structure's automatic teller machine access and provides ample machine service space in a secure environment.

An object of the invention is to provide an expandable structure the interior of which is substantially inaccessible when in a nested or normal automatic teller machine operable position.

Another object of the invention is to provide an expandable structure that is adaptable to house any configuration of an automatic teller machine.

Another object of this invention is to provide automated or manual means for telescoping the structure between automatic teller machine operating and servicing modes.

Another object of this invention is to provide additional servicing area within the expanded structure by translating the automatic teller machine outward from the structure.

Still another object of this invention is to secure both the structure and the automatic teller machine from respectively telescoping or translating when the automatic teller machine is in an operating mode.

The above and other objects will become apparent in the description below in which like numerals indicate like or similar parts or elements in the drawings in which:

DETAILED DESCRIPTION OF THE DRAWINGS

Figure 1:
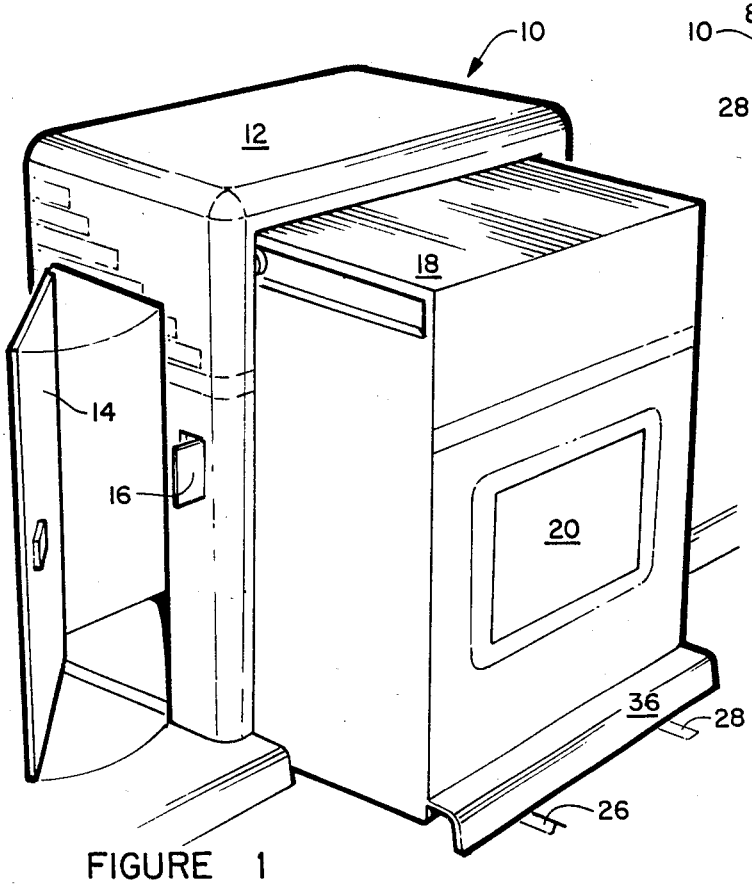
FIG. 1 is a perspective view of one embodiment of the expandable structure of the invention in an extended service position.

Referring now to the various drawing figures. FIG. 1 is a perspective showing of one embodiment of the expandable structure 10 of the invention. The structure is shown in its expanded or telescoped maximum surface area configuration. The structure is formed by two nestable sections and a support base. The outer section 12 includes an interior access door 14 and a control access door 16. The front of the outer section 12 is open to receive the open end of an interior section 18 therein. The inner section 18 is designed to have an automatic teller machine 20 fixedly secured thereto, the front surface being shown. An opening in the rear of structure (not shown), provides an opening for interior ventilation.

Figure 2:
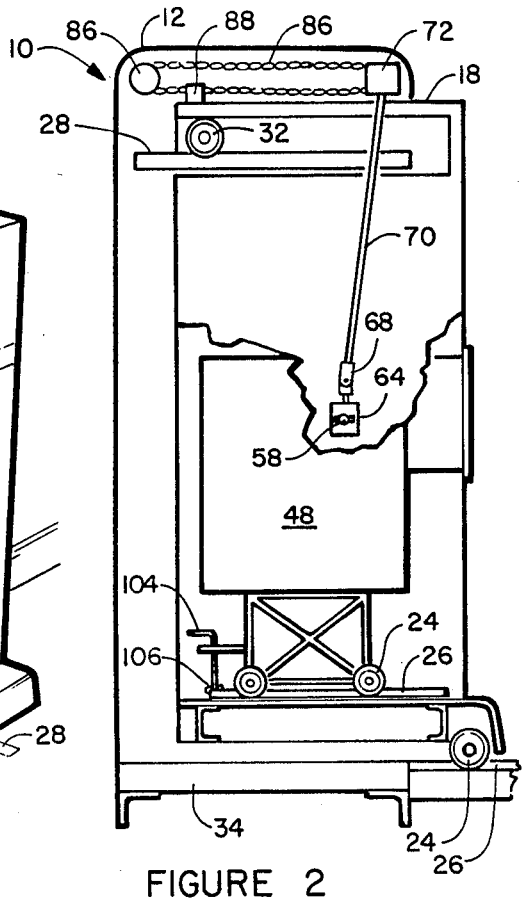
FIG. 2 is a side view of the structure of FIG. 1 in a nested operable position with the door side of the outermost section removed showing the structure sections mechanical translating means.
Figure 3:
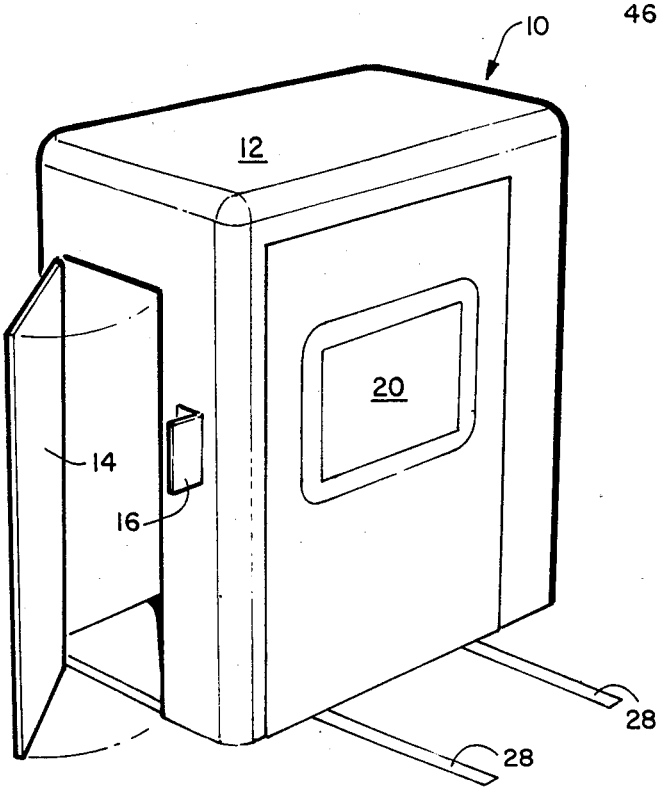
FIG. 3 is a perspective view of a second embodiment of the expandble structure of the invention in a nested operable position.
Figure 7:
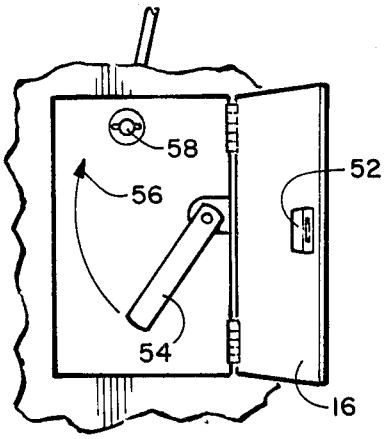
FIG. 7 is a front view of the control access panel open showing the mechanical or manual drive means and means for locking the two buildings together in a nested position.

Referring now to FIG. 2. the inner translatable section 18 is shown translated a short distance from its fully nested position (see FIG. 3). The translation is guided and supported by wheel and track combinations. Guidance is accomplished by means of a wheel 24 and a "V" shaped outer or support surface which engages and rides upon an inverted "V" shaped track 26. Additional support is provided by tracks 28 and wheels 32 with smooth or flat engaging surfaces. The "V" shaped wheel surface and inverted "V" shaped tracks may be positioned on the lower support surface or attached to the upper surface of the interior of the outer section 12 as shown in FIG. 7. Various combinations of guidance tracks and smooth tracks may be employed to practice the invention.

A base 34 is fixedly attached to the outer section 12 and supports the entire structure including the bottom tracks 26 and 28. The details of construction of the base 34 will hereinafter be discussed in more detail.

A lip or curb 36 is provided to the lower front surface of the inner section 18 for use of the structure 10 as a vehicle drive-up enclosure installation for the automatic teller machine 20.

Referring now to FIG. 3, the structure 10 (collapsed to its minumum surface configuration) of this embodiment does not include the lip or curb 36 of the FIGS. 1 and 2 structure 10 and is used to house a walk up automatic teller installation. In this embodiment the surface support tracks 28 are flat or smooth, as are the support wheel surfaces. In this configuration the upper surface of the tracks are on the same plane as their surrounding surface to prevent tripping people using or walking by the front of the structure. In the FIGS. 1 and 2 showing, it is not anticipated that there will be walk up users of the automatic teller machine and the inverted "V" rail 26 will not effect vehicles riding thereover.

Figure 4:
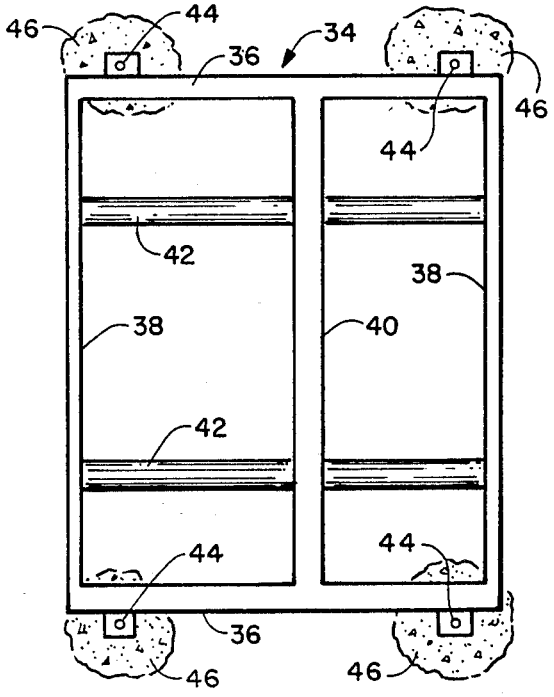
FIG. 4 is a plan view of the common support base of both embodiments of the expandable structure.

Referring now to FIG. 4, the base 34 is constructed of rigid steel or the like side beams 36, end beams 38, cross beams 40 and longitudinal stiffeners 42. The longitudinal stiffeners 42 generally will be tubular steel structures, such as steel pipe having a sufficient diameter and wall thickness to prevent the base from torquing from its normal plane when the structure 10 is fixedly attached thereto while the structure and base are being transported as an integral structure to a location site or when the inner section is translated relative to the outer section. Each side beam 36 includes securing plates 44 secured thereto. The securing plates 44 each have a central aperture 46 therethrough for attachment to surface supports 46. The surface supports 46 generally are in the form of pillars embedded in the earth which include an attachment screw embedded therein (not shown) which passes through the cental aperture 36 and is secured to the securing plates by means of a nut or the like engaging the screw threads of the screw in a conventional manner. Leveling of the structure on site during surface support attachment is accomplished by means of wedge shims or the like not shown. The elements of the base are interconnected by welding means or the like to insure rigidity.

Figure 5:
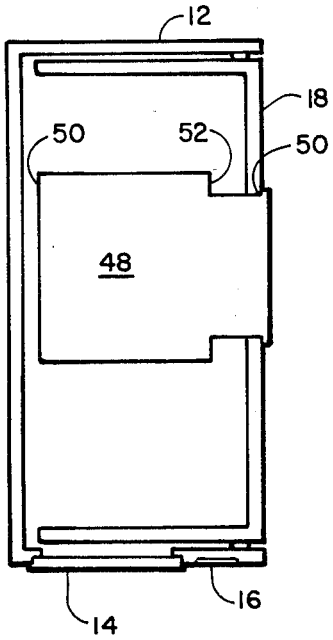
FIG. 5 is a schematic plan view showing a translatable automatic teller machine and an expandable structure of either embodiment in their operable positions.

FIG. 5 is a schematic plan showing of the embodiments of FIGS. 1 and 3 utilizing an automatic teller machine 48 which is not fixedly attached to the inner section 18 but is translatable relative thereto the distance between the outer lip 50 and the inner shoulder 52. When the structure and automatic teller machines are in the position shown in FIG. 5, the structure and automatic teller machine are in their normal or operable positions. In this position the door 14 can be opened but the side wall of the inner section 18 prevents entry into the interior of the structure 10. Further if forced entry into the interior of the structure is accomplished the rear or access door to the automatic teller machine can at most be slightly opened preventing access to the money available within the machine bank. Even if the automtic teller machine is translated relative to the inner section the distance between outer lip 50 and inner shoulder 52, access to the machine bank would not be possible.

Figure 6:
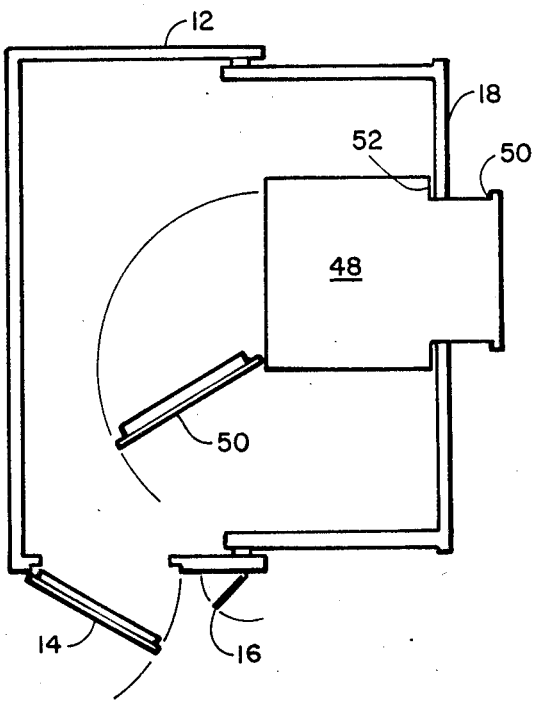
FIG. 6 is a showing of FIG. 5 with the automatic teller machine and expandable structure in their extended servicing positions.

Referring now to FIG. 6, which is a schematic plan view showing of the inner section 18 of the structure 10 translated outward to its maximum surface area as shown in FIG. 1 as well as the automatic teller machine 48 in its maximum outwardly translated position. The FIG. 6 structure and machine position is the automatic teller servicing position. In this position the opening of door 14 allows entry into the interior of the structure and allows sufficient room therein to allow door 50 on the rear of the automatic teller machine to be fully opened as required for machine servicing.

The translation of inner section 18 as well as the automatic teller machine operates as follows:

Referring now to FIGS. 2 and 7–10, in either the mechanical crank or motor driven operation lock 52 on door 16 is unlocked and the door is pivoted open as shown in FIG. 7. Lock arm 54 is then pivoted downward opposite to arrow 56 to its FIG. 7 position. The rotation of lock am 54 in this manner exposes the crank attachment 58 and translates locking pin 60, attached to the lock arm 54 from its engagement with opening 62 to its FIG. 8 position freeing the inner lock between the outer and inner sections of the structure thus allowing the inner section 18 to translate relative to outer section 12.

Figure 9B:
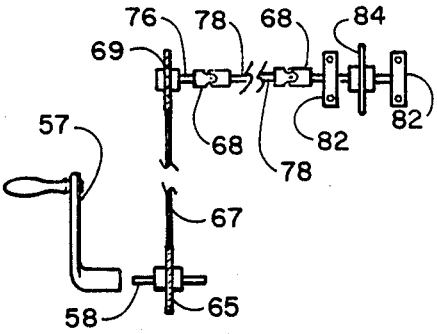
FIG. 9B is a front view showing of a second embodiment of the manually operated drive means for translating the inner structure section relative to the outer structure section.
Figure 9A:
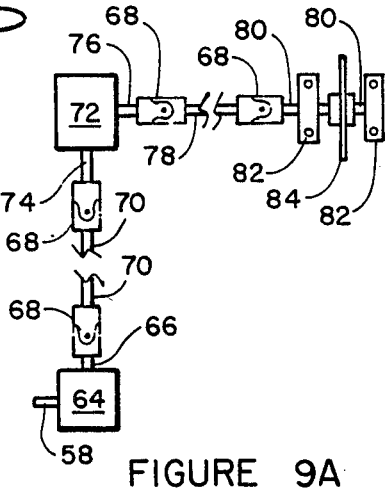
FIG. 9A is a front view showing of the mechanical or manually operated drive means for translating the inner structure section relative to the outer structure section.

Referring now specifically to FIG. 9A, a removable crank 57 is then interconnected to crank attachment 58. The rotation of the crank connection 58 rotates reduction gears in gear box 64 which produces a two to one rotational reduction at output shaft 66 of gear box 64. Connected through a universal connector 68 is a drive shaft 70. Drive shaft 70 interconnects right angle drive unit 72 through a second universal connector 68. The rotational input at shaft 74 and at output shaft 76 of right angle drive unit are equal (1 to 1). A second drive shaft 78 is interconnected to output shaft 76 and axle 80 through a pair of universal connectors 68. Axle 80 is held in place by a pair of spaced apart bushings 82. Positioned between the bushings 82 is a sprocket 84 fixedly attached to the axle 80. A chain 86 passes around sprocket 84 and a second sprocket 86 and is connected at each end to inner section attached connector 88. As should be understood from the drawings the rotation of crank connector 58 rotates sprockets 84 and 86 at half crank speed causing the inner section 18 to translate relative to outer section 12 in or out according to the direction of the rotation of crank connector 58.

Referring now specifically to FIG. 9B there is shown a second embodiment of a manual drive means for translating inner section 12. The system operates the same as that system depicted in FIG. 9A and described above. In this second embodiment the crank attachment 58 is attached to a first sprocket 65 which drives a second sprocket 69 by means of a chain 67 therebetween. Sprocket 65 is larger in diameter than sprocket 69 so that every two rotations of the crank attachment 58 provides a single rotation of sprocket 69 and attached shaft 76. The remainder of the components employed are the same as hereinbefore discussed. It should be obvious that the translation operation is as discribed above.

It should be understood that various other ratios between the crank attachment 58 and output shaft 76 can be employed to practice this invention.

In the motorized version the axle 90 fixedly attached to sprocket 86 extends beyond the width of the inner section 18 and includes a second sprocket 92 fixedly attached thereto. The axle rotation is supported by bearings 82. An electric motor 94 is interconnected through a reduction box 96 attached to its output shaft to an axle 98 which in turn is connected to sprocket 100 through an electric clutch 102. The axle 98 connected to the output of reduction box 96 should rotate at a slow enough speed to translate the inner section 18 relative to the outer section 12 at approximately four inches a second. It has been found that a one third horse power motor operating at 1100 RPM with a 60:1 rotational reduction in reduction box 96 is suitable. It should be obvious that combinations of different sized motors, rotational speeds and reduction gearing may be used to practice this invention.

Figure 8:
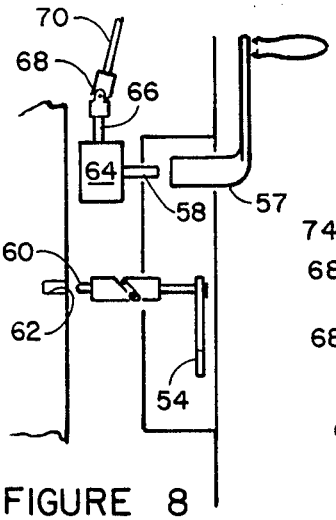
FIG. 8 is a side view showing of FIG. 7.

Like hereinbefore discussed, locking pin 60 must be in its FIGS. 7 and 8 position prior to energizing the motor 94. The controls for motor 94 operation may be located behind door 16 or remotely located.

Figure 10:
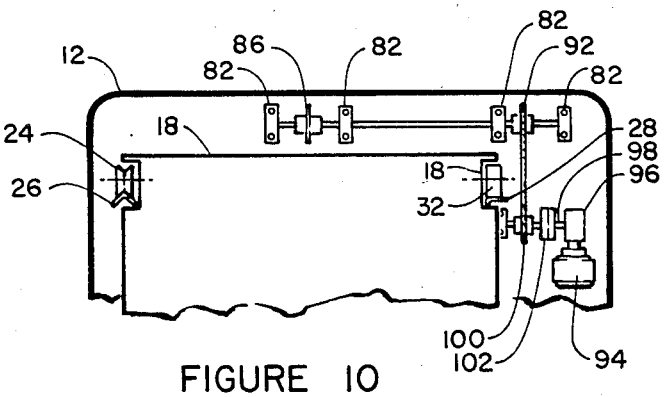
FIG. 10 is a cut-away front view of the expandable structure of FIGS. 1 and 3 showing details of the motorized drive for providing relative translation of the two sections of the expandable structure.

Referring again to FIG. 2, to translate the automatic teller machine 48, lock rod 104 must be disengaged from the aperture 106 in track 26 by pulling upwardly and while the lock rod is disengaged, the machine 48 is manually pushed toward the front of the inner section 18 to its FIG. 6 position. Similar wheel and track guidance and support as that shown in FIGS. 1, 3 and 10 are utilized.

The structure of the invention thus offers a number of unique advantages which make it particularly suitable for use in public locations both for vehicle drive up and walk up operations. The structure when collapsed in its operational mode is compact and may be installed as a free standing structure without the dedication of additional space to permit servicing of the machine. The machine is serviced from within the structure to provide the required security. Security is further improved by the fact that the interior is not accessible in the structure's operational collapsed mode. It is thus apparent that the structure of the invention offers many unique and advantageous features which make it particularly suitable for the installation of an automatic teller machine in a public area.

Structure 10 may be suitably decorated to be compatible with its surroundings and yet provide an attractive and secure enclosure for an automatic teller machine.

As various changes could be made on the above construction without departing from the scope of the invention, it is intended that all matter contained in the above description or shown in the accompanying drawings shall be interpreted as illustrations and not in a limiting sense.

What is claimed is:

1. An expandable security structure for housing an automated teller machine having customer controls, said structure has front and back adjacent surface areas comprising:

a base member fixed in place adjacent said surface areas;

a first and second section, said first section having a closed rear surface adjacent said back surface area, closed sides and an open surface adjacent said front surface area and a second section housing said automated teller machine, said second section having an open back surface, closed side surfaces and an opening adjacent said front surface area for exposing said customer controls, said second section is nestible within said first section and translatable relative thereto and said automated teller machine is translatable forwardly relative to said opening in said second section between a first operable position wherein one side thereof is substantially flush with the front of said second section and a second servicing position wherein said one side of said automated teller machine is extended exteriorly from said front of said second section;

means for translating said second section relative to said first section between a first automated teller access position wherein the two sections are nested together and a second automated teller servicing position wherein the second section is telescoped outwardly from said first section to a position over said front surface area; and means for guiding said second section relative to said first section during translation thereof;

whereby when said sections are in said first nested position entry into the interior of said structure through said door is prevented by the presence of said side surface of said second section positioned beneath said door and when in said telescoped second position said side surface of said second section is translated away from beneath said door said interior of said structure is accessible through said door, the front adjacent surface is inaccessible and the rear adjacent surface remains accessible.

2. The invention as defined in claim 1 wherein said means for translating said second section relative to said first section comprises motor driven means.

3. The invention as defined in claim 1 wherein said means for translating said second section relative to said first section comprises manual operated driving means.

4. The invention as defined in claim 1 wherein said base is connected to its supporting surface only at each corner thereof.

5. The invention as defined in claim 4 wherein the connection between said base and said supporting surface is adjustable.

6. The invention as defined in claim 4 wherein said base comprises means to substantially prevent any longitudinal distorting of said base when said section is translated between said first and second positions.

7. The invention as defined in claim 1 wherein the only direction of translation of said automated teller machine is parallel to the translation of said second section.

8. The invention as defined in claim 1 wherein a locking means is provided to lock said automated teller machine in its first operable position.

9. The invention as defined in claim 1 wherein said means for translating said one of said sections includes locking means for selectively preventing said translating thereof.

10. The invention as defined in claim 1 wherein said door is located in one side of said first section.

* * * * *